US010855032B1

(12) United States Patent
Davila Morales et al.

(10) Patent No.: US 10,855,032 B1
(45) Date of Patent: Dec. 1, 2020

(54) ELECTRICAL CONNECTOR

(71) Applicant: GM GLOBAL TECHNOLOGY OPERATIONS LLC, Detroit, MI (US)

(72) Inventors: Felipe De Jesus Davila Morales, Toluca (MX); Farid Arturo Quiroz Castilla, Toluca (MX); Moises Munoz Ramos, Toluca (MX); Ignacio Eduardo Tellez Giron Schroeder, Toluca (MX)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/729,948

(22) Filed: Dec. 30, 2019

(51) Int. Cl.
*H01R 13/40* (2006.01)
*H01R 13/641* (2006.01)
*H01R 13/66* (2006.01)
*H01R 13/46* (2006.01)

(52) U.S. Cl.
CPC ..... *H01R 13/641* (2013.01); *H01R 13/465* (2013.01); *H01R 13/6683* (2013.01)

(58) Field of Classification Search
CPC ..... H01R 103/00; H01R 13/514
USPC ..... 439/598, 701
See application file for complete search history.

(56) References Cited

U.S. PATENT DOCUMENTS 2,928,066 A * 3/1960 Gordon ..... H01R 9/2408 439/717
3,173,738 A * 3/1965 Gluntz ..... H01R 13/518 439/716
3,409,858 A * 11/1968 Krehbiel ..... H01R 13/62 439/354
9,608,382 B2 * 3/2017 McClellan ..... H01R 13/6587

* cited by examiner

*Primary Examiner* — Phuong Chi Thi Nguyen
(74) *Attorney, Agent, or Firm* — Cantor Colburn LLP

(57) ABSTRACT

An electrical connector includes first and second bodies, an electrical terminal, a shuttle, and a scannable code. The first body includes a wall and a bridge. The wall has an outward surface facing radially outward with respect to a mating axis, and an opposite inward surface defining a blind opening. The bridge extends lengthwise between opposite end portions each attached to the outward surface. The bridge and the outward surface define a through opening opened axially, and spaced radially outward from, the blind opening. The electrical terminal projects axially, is attached to the first body, and is revealed through the blind opening. The second body is axially received in the blind opening and mates with the first body. The shuttle is adapted to axially slide through the opening. The scannable code is secured to the shuttle, faces radially outward, and is concealed by the bridge when the connector is unmated.

19 Claims, 4 Drawing Sheets

ELECTRICAL CONNECTOR

INTRODUCTION

The subject disclosure relates to electrical connectors, and more particularly, to auditable electrical connectors.

Confirmation that electrical connectors are completely, or properly connected, is not easily, or quickly, achieved. Moreover, documentation that such a confirmation was even conducted is another process that can be cumbersome and has the potential for error or mistakes.

Accordingly, it is desirable to provide a quick and easy way to confirm and document proper connection of electrical connectors.

SUMMARY

In one exemplary, non-limiting, embodiment, an electrical connector includes first and second bodies, a first electrical terminal, a shuttle, and a scannable code. The first body includes a wall and a bridge. The wall has an outward surface facing radially outward with respect to a mating axis, and an inward surface facing radially inward and defining a blind opening opened axially. The bridge extends lengthwise between opposite end portions of the bridge, each being attached to the outward surface. The bridge and a portion of the outward surface define a through opening opened axially and spaced radially outward from the blind opening by the wall. The electrical terminal projects axially, is attached to the first body, and is revealed through the blind opening. The second body is axially received in the blind opening and mates with the first body. The shuttle is adapted to axially slide through the opening. The scannable code is secured to the shuttle and faces radially outward. The scannable code is axially aligned to, and is radially inward from, the bridge when the electrical connector is in an unmated position.

Additionally to the foregoing embodiment, the shuttle is supported by the first body when the electrical connector is in the unmated position and a mated position.

In the alternative or additionally thereto, in the foregoing embodiment, the scannable code includes an axial distance that is equal to, or less than, an axial height of the bridge.

In the alternative or additionally thereto, in the foregoing embodiment, the electrical connector includes a core of the second portion adapted to be received in the blind opening, wherein the second terminals are attached to the core; and a shoulder projecting radially outward from the core, and adapted to abut the shuttle as the first and second bodies are axially mated.

In the alternative or additionally thereto, in the foregoing embodiment, the first body includes a stop projecting radially outward from the outward surface, axially spaced from the bridge, and circumferentially aligned to the bridge.

In the alternative or additionally thereto, in the foregoing embodiment, the shuttle is axially secured between the stop and the shoulder when in the mated position.

In the alternative or additionally thereto, in the foregoing embodiment, the scannable code represents an identification of the electrical connector.

In the alternative or additionally thereto, in the foregoing embodiment, the shuttle is a separate piece not rigidly formed to either the first or second bodies.

In the alternative or additionally thereto, in the foregoing embodiment, the shuttle is rigidly fixed and attached to the second body.

In the alternative or additionally thereto, in the foregoing embodiment, the shuttle is spaced radially outward from the core.

In the alternative or additionally thereto, in the foregoing embodiment, the electrical connector includes a sensor attached to one of the first and second bodies, wherein the bar code identifies the sensor and identification of the sensor confirms mating of the first and second bodies.

In the alternative or additionally thereto, in the foregoing embodiment, the scannable code is a matrix code.

In the alternative or additionally thereto, in the foregoing embodiment, the scannable code is a bar code.

In accordance with another, non-limiting, embodiment, an electrical connector includes a mating axis, a first body, a first electrical terminal, a second body, a second electrical terminal, and a scannable code. The first body defines a window opened radially outward with respect to the mating axis. The first electrical terminal is attached to the first body. The second body is adapted to mate with the first body. The second electrical terminal is attached to the second body, and is adapted to axially mate with the first electrical terminal when the first and second bodies are axially mated. The scannable code is carried between the first and second bodies, and is adapted to be revealed through the window when the first and second bodies are fully mated.

Additionally to the foregoing embodiment, the first and second bodies are electrically non-conductive.

In the alternative or additionally thereto, in the foregoing embodiment, the electrical connector includes a wall of the first body being circumferentially continuous, and including an outward surface facing radially outward, and an inward surface defining a blind opening adapted to axially receive the second body. The bridge of the first body extends circumferentially with respect to the mating axis, and between opposite end portions of the bridge. The opposite end portions are each attached to the outward surface. The bridge, and a portion of the outward surface, define a through bore. The shuttle is adapted to extend through, and axially slide within, the through bore. The shuttle carries the scannable code.

In the alternative or additionally thereto, in the foregoing embodiment, the through opening is spaced radially from the blind opening via the wall.

In the alternative or additionally thereto, in the foregoing embodiment, the scannable code is at least partially axially aligned to the bridge and the wall when the first and second bodies are in an unmated position thereby at least partially concealing the scannable code.

In the alternative or additionally thereto, in the foregoing embodiment, the wall includes a leading edge facing axially, the bridge is axially disposed between the window and the leading edge, and the bridge in-part defines the window.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
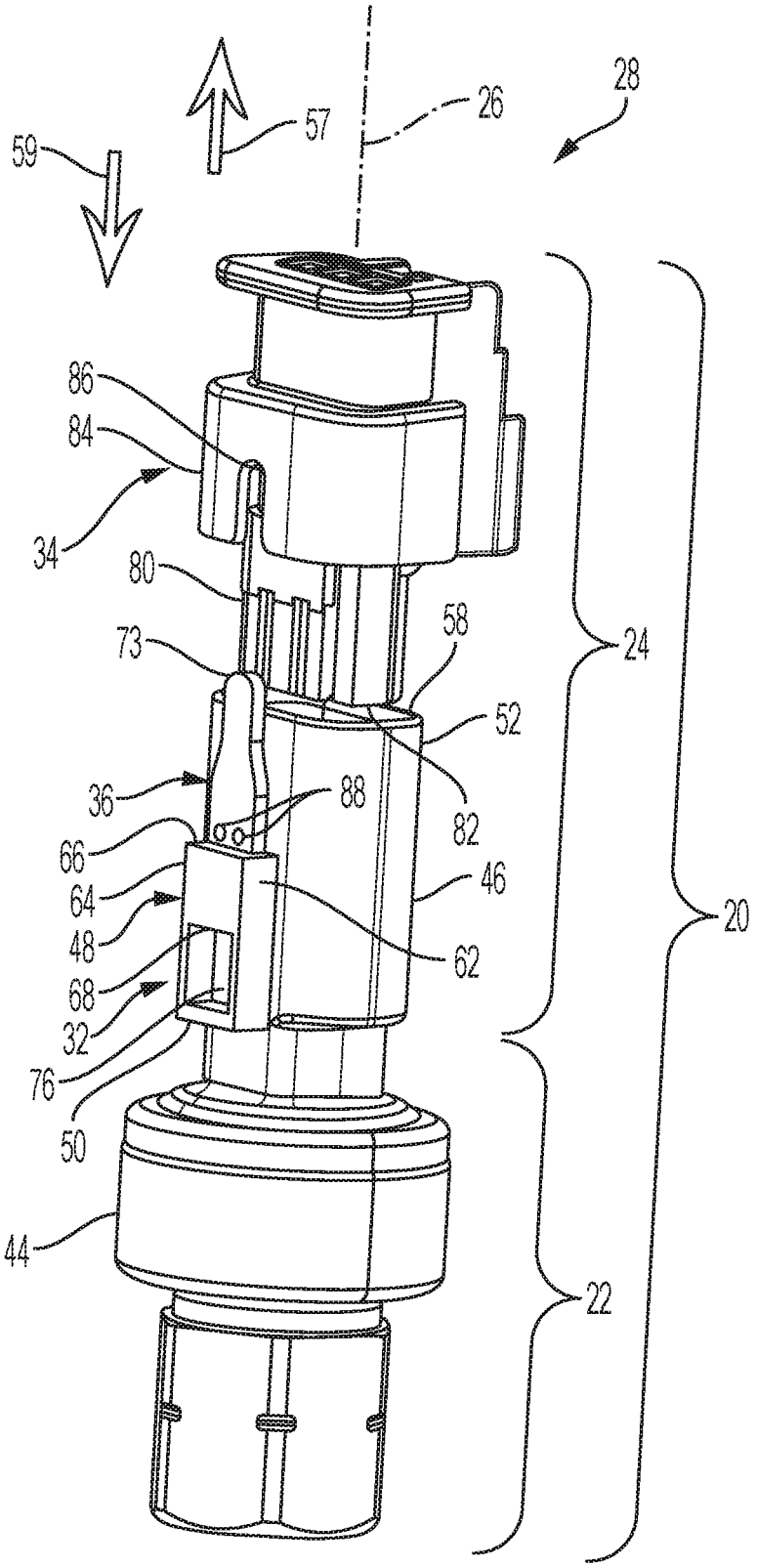
FIG. 1 is a perspective view of a sensor assembly including an auditable electrical connector illustrated in an unmated position.

The following description is merely exemplary in nature and is not intended to limit the present disclosure, its application or uses. It should be understood that throughout the drawings, corresponding reference numerals indicate like or corresponding parts and features.

In accordance with an exemplary, non-limiting, embodiment, a sensor assembly 20 is illustrated in FIG. 1. The sensor assembly 20 includes a sensor 22 and an auditable electrical connector 24. In an embodiment, the sensor is a pressure sensor. However, it is contemplated and understood that the sensor 22 may be any type of sensor, and the electrical connector 24 may be any type of electrical connector.

Figure 2:
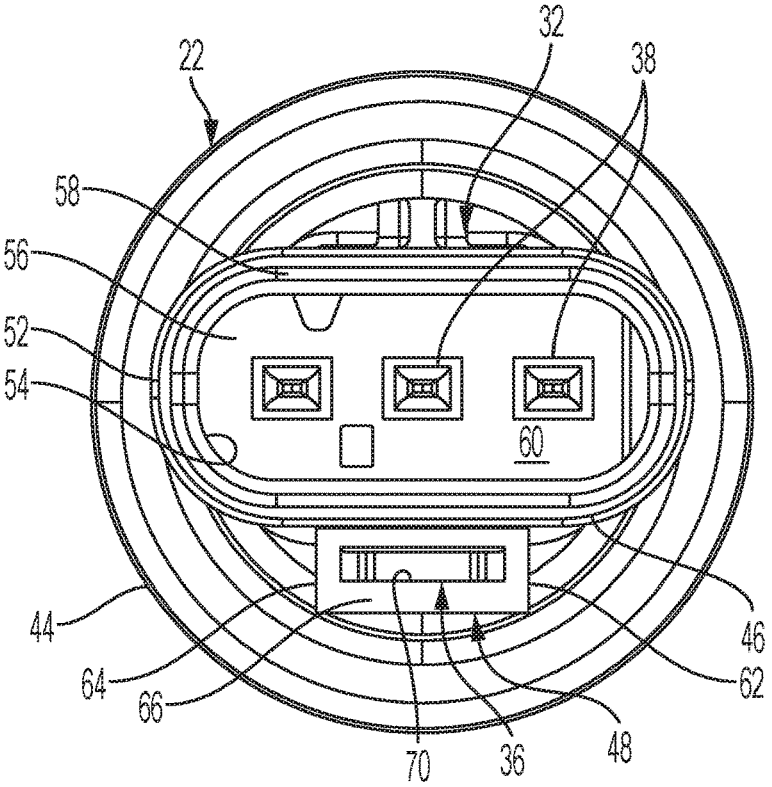
FIG. 2 is an axial end view of a first body of the auditable electrical connector.
Figure 3:
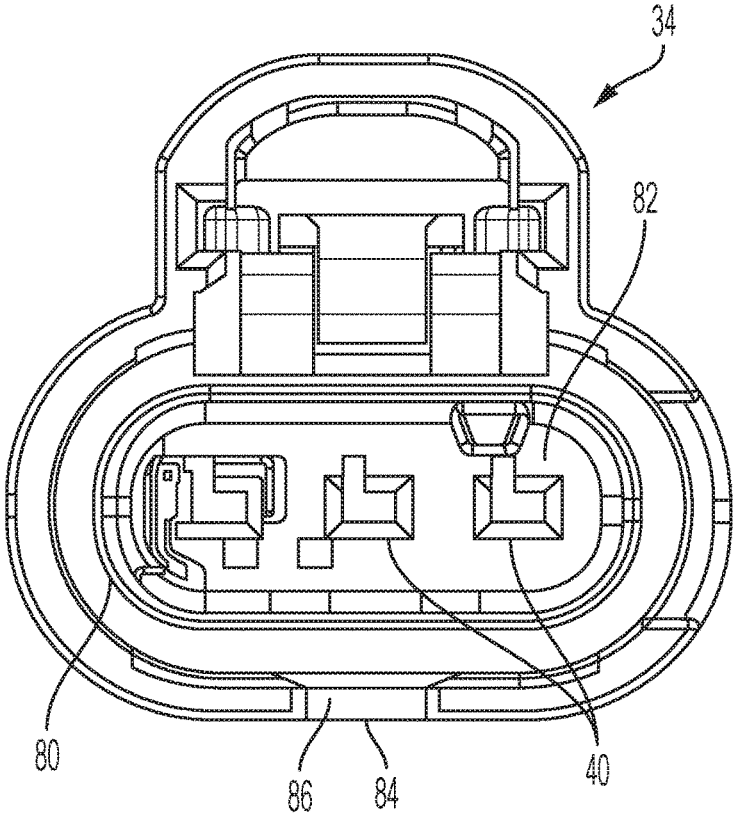
FIG. 3 is an axial end view of a second body of the auditable electrical connector.
Figure 4:
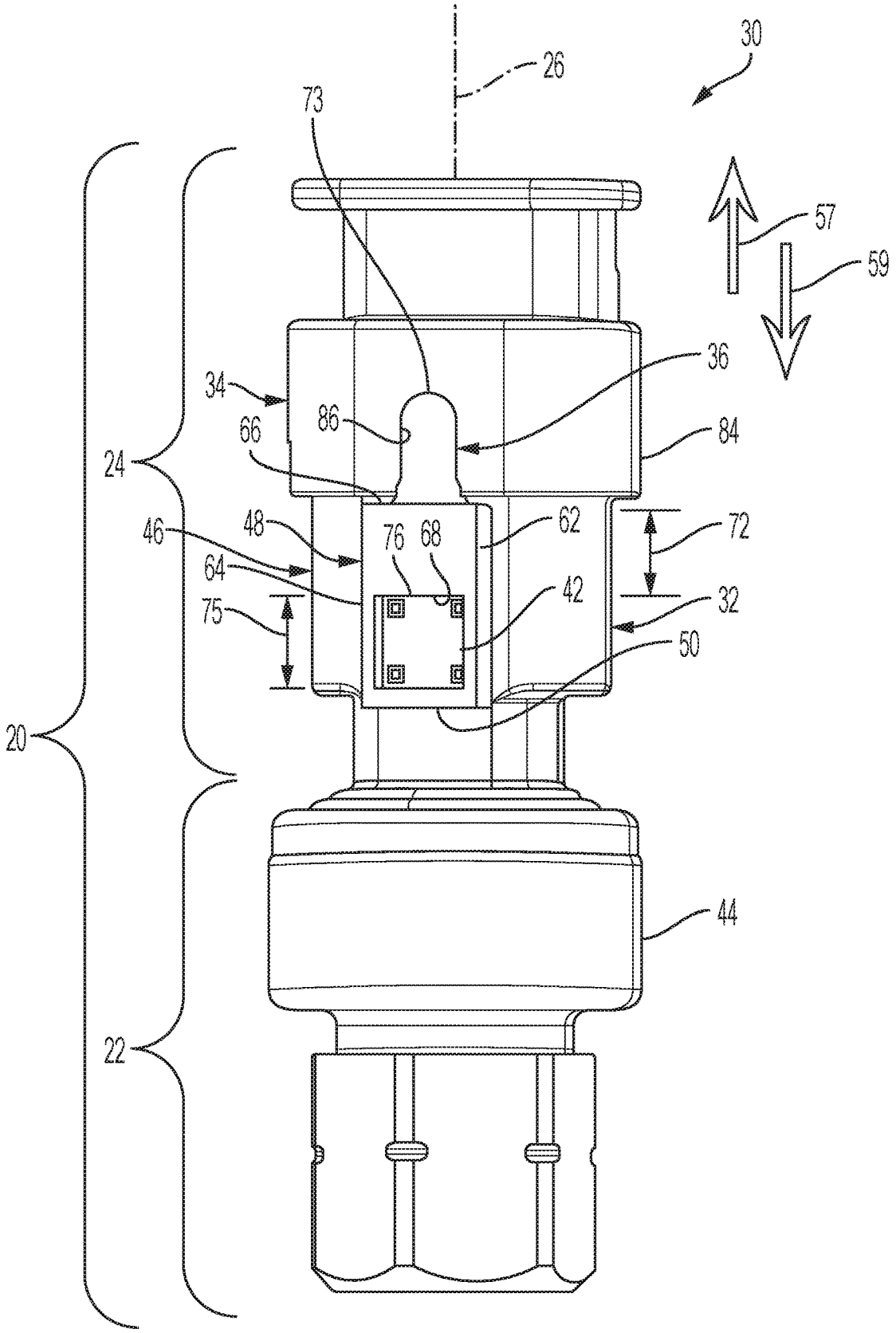
FIG. 4 is a perspective view of the sensor assembly with the auditable electrical connector illustrated in a mated position.

The auditable electrical connector 24 is adapted to mate along a mating axis 26, and between an unmated position 28 (see FIG. 1) and a mated position 30 (see FIG. 4). The electrical connector 24 includes a first body 32, a second body 34, a third body 36, at least one electrical first terminal 38 (i.e., three illustrated as male terminals in FIG. 2), at least one electrical second terminal 40 (i.e., three illustrated as female terminals in FIG. 3), and a scannable code 42. The first and second bodies 32, 34 are made of an electrically, non-conductive, material. The first and second electrical terminals 38, 40 are made of an electrically conductive material, and are attached, and housed, to the respective first and second bodies 32, 34.

The first body 32 may be an integral, or unitary, part of a housing 44 of the sensor 22. As illustrated, the first body 32 is female, and the second body 34 is male adapted to be received, and mated to, the first body 32 along the axis 26. As is generally known in the art of electrical connectors, as the first and second bodies 32, 34 mate, the terminals 38, 40 mate to each other to complete an electrical connection for the transmission of electrical power and/or electrical signals.

The first body 32 may include a wall 46, a bridge 48, and a stop 50. The wall 46 extends about the axis 26, and may be circumferentially continuous. The wall 46 includes an outward surface 52 that faces radially outward with respect to axis 26, an inward surface 54 that faces radially inward, a bottom surface 56 that faces axially (see FIG. 2) in an axial direction (see arrow 57), and a leading edge 58 that spans between the surfaces 52, 54 and faces in the axial direction 57. The inward surface 54 and the bottom surface 56 include boundaries that define a blind opening 60 (i.e., blind bore, see FIG. 2) for axial receipt of the second body 34. The first terminals 38 project axially outward from the bottom surface 56 and into the blind opening 60.

The bridge 48 includes opposite end portions 62, 64, a leading edge 66, and a trailing edge 68. The leading edge 66 faces in axial direction 57, and the trailing edge faces in an opposite axial direction (see arrow 59 in FIG. 1). The edges 66, 68, and thus the bridge 48, extends circumferentially with respect to axis 26, and between the end portions 62, 64. The end portions 62, 64 are attached to the outward surface 52 of the wall 46. A portion of the outward surface 52 of the wall 46 and the bridge 48 include boundaries that define a through opening 70 for axial receipt of the third body 36. The through opening 70 is radially spaced from the blind opening 60 by the wall 46.

The bridge 48 includes an axial height (see arrow 72 in FIG. 4) that is measured from, and between the edges 66, 68. The stop 50 projects radially outward from the outward surface 52 of the wall 46, is circumferentially aligned to the bridge 48, and is space rearward from (i.e., trails) the trailing edge 68 of the bridge 48 by an axial distance (see arrow 75 in FIG. 4). The trailing edge 68 of the bridge 48 and the stop 50 define a window 76 (see FIG. 1) having an axial height being the axial distance 75. In an embodiment, the axial height 72 of the bridge 72 is about equal to or greater than the axial height, or distance, 75 of the window 76.

Figure 5:
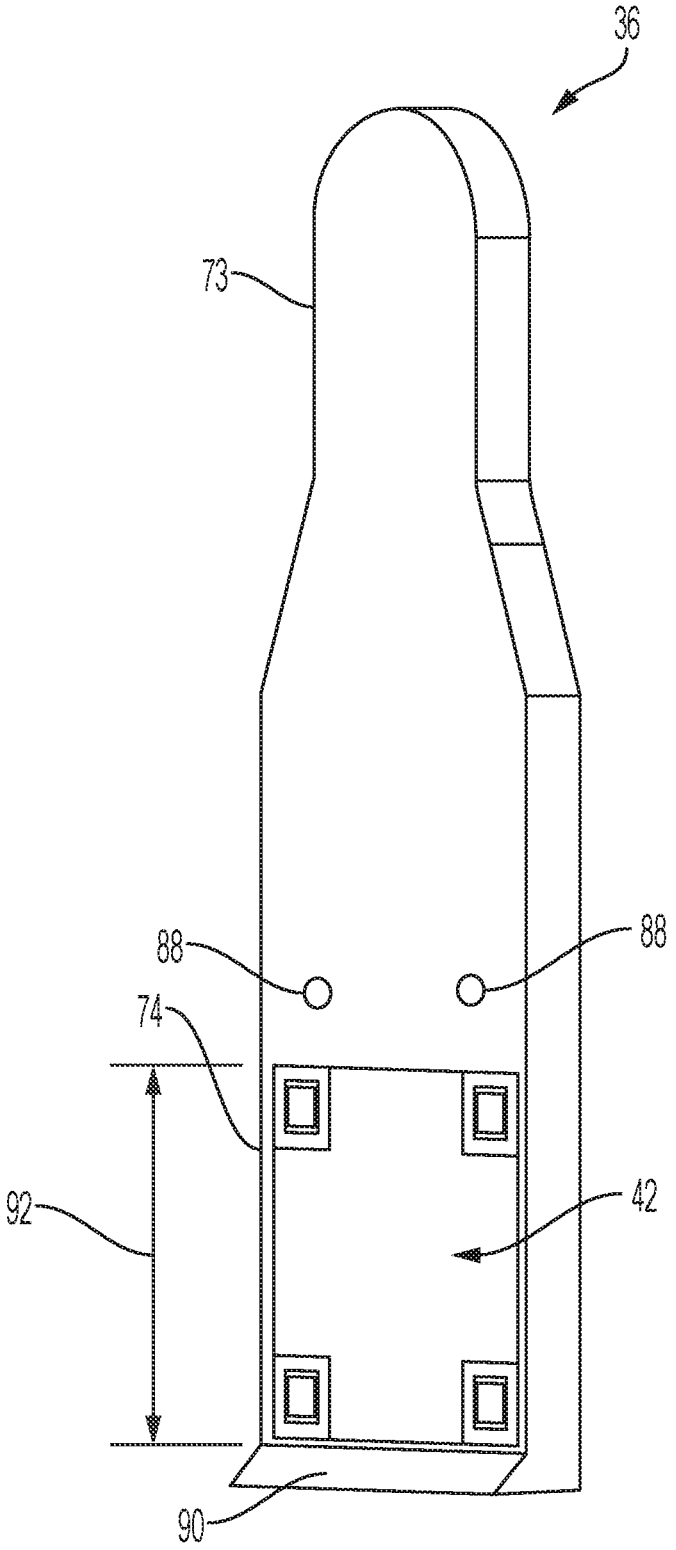
FIG. 5 is a perspective view of a third body of the auditable electrical connector.

Referring to FIGS. 1, 4, and 5, the scannable code 42 is attached, or otherwise printed upon, the third body 36, and faces radially outward with respect to axis 26. In an embodiment, the third body 36 may be a shuttle that is pre-staged (i.e., slideably connected to) the first body 32. More particularly, the third body 36 may include opposite end segments 73, 74. When assembled, end segment 73 projects in axial direction 57, and end segment 74 projects in axial direction 59. The scannable code 42 is attached to end segment 74 and is axially positioned to be revealed through the window 76 when the electrical connector 24 is in the mated position 30, and is hidden radially behind the bridge 48 when the third body 36 is first pre-staged to the third body 32 (i.e., the electrical connector 24 is in the unmated position (28)). In an embodiment, the scannable code 42 includes an axial height (see arrow 92 in FIG. 5) that is about equal to the axial height 75 of the window 76, and is about equal to, or smaller than, the axial height 72 of the bridge 48.

Referring to FIGS. 1 and 3, the second body 34 includes a core 80 having a leading face 82 facing in the axial direction 59, and a shoulder 84. The terminals 40 (e.g., female terminals) are attached to, and may be disposed within, the core 80, such that the terminals 40 are axially exposed through the leading face 82. The core 80 is adapted to be axially received in the opening 60 of the first body 32. The shoulder 84 projects radially outward from the core 80, is axially spaced from the leading face 82, and is orientated to axially abut the end segment 73 of the third body 36 during mating of the electrical connector 24 (see FIG. 4). In an embodiment, the shoulder 84 extends circumferentially and continuously about the core 80 with respect to axis 26, and includes boundaries that define a fitted alcove 86 (see FIG. 1) for fitted receipt of the end segment 73 of the third body 36.

In an embodiment, the end segment 73 of the third body 36 axially projects beyond the leading edge 58 of the wall 46 when pre-staged to the first body 32. The third body 36 also includes trailing and leading indexes 88, 90 that project outward from the end segment 74, and in a radially outward direction with respect to axis 26, to facilitate axial placement of the third body 36 when pre-staged. Specifically, when pre-staged, the indexes 88 are proximate to, or abut, the leading edge 66 of the bridge 48, and the indexes 90 are proximate to, or abut, the trailing edge 68.

The scannable code 42 may be a matrix code, a bar code, or any other code adapted to be scanned by a scanner (e.g., infrared scanner) not shown. Readings taken by the scanner may be stored (e.g., electronic storage medium of a controller), confirming that the sensor assembly 20 was checked, or otherwise inspected, and passed the inspection. In an embodiment, the mere ability to read the scannable code 42 is the confirmation of a proper electrical connection. In another embodiment, the scannable code 42 is associated with a model number, or a serial number, of the sensor 22 itself. In this way, not only is the electrical connector 24 confirmed to be properly connected, but the electrical connector 24 associated with a specific sensor is confirmed to be properly connected. This confirmation may then be stored as, for example, quality confirmation data.

During mating of the electrical connector 24, the third body 36 is pre-staged to the first body 32 as previously described. As the first and second bodies 32, 34 move toward one-another along axis 26, the core 80 of the second body 34 enters the blind opening 60 of the first body 32. After this initial entry, the end segment 73 of the third body 36 enters the alcove 86. With continued insertion, the end segment 73 abuts the shoulder 84 of the second body 34 and the third body 36 leaves the pre-staged location. With still more insertion, the scannable code 42 begins to be revealed through the window 76. When the electrical connector 24 is fully mated (i.e., in the mated position 30 illustrated in FIG. 1), the scannable code 42 is completely revealed through the window 76, and thus scannable.

In other embodiments, the auditable electrical connector 24 may not include a shuttle. Instead, the third body 36 may be a unitary or integral part of one of the first and second bodies 32, 34, and the scannable code 42 remains secured to the third body. The other of the first and second bodies 32, 34 may define the window 76 for revealing the scannable code 42.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof

What is claimed is:

1. An electrical connector comprising:

a first body including a wall having an outward surface facing radially outward with respect to a mating axis and an inward surface facing radially inward and defining a blind opening opened axially, and a bridge extending lengthwise between opposite end portions of the bridge each attached to the outward surface, wherein the bridge and a portion of the outward surface define a through opening opened axially and spaced radially outward from the blind opening by the wall;

a first electrical terminal projecting axially, attached to the first body, and revealed through the blind opening;

a second body adapted to be axially received in the blind opening and mate with the first body;

a shuttle adapted to axially slide through the through opening; and a scannable code secured to the shuttle and facing radially outward, wherein the scannable code is axially aligned to, and radially inward from, the bridge when the electrical connector is in an unmated position.

2. The electrical connector set forth in claim 1, wherein the shuttle is a separate piece not rigidly formed to either the first or second bodies.

3. The electrical connector set forth in claim 1, wherein the shuttle is rigidly fixed and attached to the second body.

4. The electrical connector set forth in claim 1, further comprising a sensor attached to one of the first and second bodies, wherein the bar code identifies the sensor and identification of the sensor confirms mating of the first and second bodies.

5. The electrical connector set forth in claim 1, wherein the scannable code is a matrix code.

6. The electrical connector set forth in claim 1, wherein the scannable code is a bar code.

7. The electrical connector set forth in claim 1, wherein shuttle is supported by the first body when the electrical connector is in the unmated position and a mated position.

8. The electrical connector set forth in claim 7, wherein the scannable code includes an axial distance that is equal to, or less than, an axial height of the bridge.

9. The electrical connector set forth in claim 7, further comprising:

a core of the second portion adapted to be received in the blind opening, wherein the second terminals are attached to the core; and a shoulder projecting radially outward from the core, and adapted to abut the shuttle as the first and second bodies are axially mated.

10. The electrical connector set forth in claim 9, wherein the shuttle is spaced radially outward from the core.

11. The electrical connector set forth in claim 9, wherein the first body includes a stop projecting radially outward from the outward surface, axially spaced from the bridge, and circumferentially aligned to the bridge.

12. The electrical connector set forth in claim 11, wherein the shuttle is axially secured between the stop and the shoulder when in the mated position.

13. The electrical connector set forth in claim 12, wherein the scannable code represents an identification of the electrical connector.

14. An electrical connector comprising:

a mating axis;

a first body defining a window opened radially outward with respect to the mating axis;

a first electrical terminal attached to the first body;

a second body adapted to mate with the first body;

a second electrical terminal attached to the second body and adapted to axially mate with the first electrical terminal when the first and second bodies are axially mated; and a scannable code carried between the first and second bodies and adapted to be revealed through the window when the first and second bodies are fully mated.

15. The electrical connector set forth in claim 14, wherein the first and second bodies are electrically non-conductive.

16. The electrical connector set forth in claim 14, further comprising:

a wall of the first body being circumferentially continuous, and including an outward surface facing radially outward and an inward surface defining a blind opening adapted to axially receive the second body;

a bridge of the first body extending circumferentially with respect to the mating axis and between opposite end portions of the bridge, wherein the opposite end portions are each attached to the outward surface, wherein the bridge and a portion of the outward surface define a through bore; and a shuttle adapted to extend through, and axially slide within the through bore, wherein the shuttle carries the scannable code.

17. The electrical connector set forth in claim 16, wherein the through opening is spaced radially from the blind opening via the wall.

18. The electrical connector set forth in claim 17, wherein the scannable code is at least partially axially aligned to the bridge and the wall when the first and second bodies are in an unmated position thereby at least partially concealing the scannable code.

19. The electrical connector set forth in claim 18, wherein the wall includes a leading edge facing axially, the bridge is axially disposed between the window and the leading edge, and the bridge in-part defines the window.

* * * * *